US010165883B1

(12) United States Patent
Glendinning

(10) Patent No.: US 10,165,883 B1
(45) Date of Patent: Jan. 1, 2019

(54) CAN HOLDER SYSTEM

(71) Applicant: Ken Glendinning, Port Franks (CA)

(72) Inventor: Ken Glendinning, Port Franks (CA)

( * ) Notice: Subject to any disclaimer, the term of this patent is extended or adjusted under 35 U.S.C. 154(b) by 0 days.

(21) Appl. No.: 15/850,161

(22) Filed: Dec. 21, 2017

(51) Int. Cl.
*A45F 3/16* (2006.01)
*A47G 23/02* (2006.01)
*A45F 5/02* (2006.01)

(52) U.S. Cl.
CPC ..... *A47G 23/0225* (2013.01); *A45F 5/021* (2013.01); *A47G 23/0266* (2013.01); *A45F 2200/0583* (2013.01)

(58) Field of Classification Search
CPC ..... Y10T 24/1382; Y10T 24/1394
USPC ..... 248/311.2, 300, 301, 312, 316.6; 220/737, 738; 224/148.7, 482, 560, 926
See application file for complete search history.

(56) References Cited

U.S. PATENT DOCUMENTS 1,915,958 A 6/1933 Skirrow
2,116,148 A * 5/1938 Hawley ..... A45F 5/10 206/446
2,532,244 A * 11/1950 Pasmore ..... A47G 23/0266 211/85.18
2,831,647 A 4/1958 MacKay
3,128,984 A * 4/1964 Palm ..... B60N 3/103 108/49
4,678,154 A * 7/1987 McFarland ..... A47K 1/08 220/737
4,893,773 A 1/1990 Fujimoto
4,951,910 A * 8/1990 March ..... B60N 3/103 224/482
5,325,991 A * 7/1994 Williams ..... A45F 5/02 215/12.1
5,361,950 A * 11/1994 Signal ..... B60N 3/103 224/482
5,697,587 A * 12/1997 Israel ..... B60N 3/103 248/214
5,865,412 A * 2/1999 Mason ..... A47C 7/62 248/214
6,883,765 B2 * 4/2005 Lozano ..... A47G 23/0225 220/62
7,398,951 B1 * 7/2008 Sugalski ..... A61G 7/0503 248/214
8,047,493 B1 * 11/2011 Cohen ..... B62J 11/00 248/300
9,004,433 B2 4/2015 Krieger
2001/0013568 A1 * 8/2001 Berenguer ..... A45F 5/02 248/311.2
2004/0217247 A1 * 11/2004 Andrews ..... B60N 3/103 248/311.2

(Continued)

*Primary Examiner* — Terrell L McKinnon
*Assistant Examiner* — Michael McDuffie
(74) *Attorney, Agent, or Firm* — Integrity Patent Group, PLC; Charles E. Runyan

(57) ABSTRACT

A can holder system including a stamped sheet having a first-section including a first-tab, and a second-tab, a second-section including a third-tab, and a fourth-tab, an arcuate-member, and a plurality of folding joints. The stamped sheet is configured to fold at the plurality of folding joints for supporting a container in a substantially upright position between uses. The device may be stored in a planar position and be folded at a plurality of folding joints to erect a container caddy. The device may be attached to a belt or a wall for convenient storage and access to a container, can, or beverage cup.

17 Claims, 5 Drawing Sheets

(56) References Cited

U.S. PATENT DOCUMENTS

2009/0266961 A1* 10/2009 Lewis ..... A45F 5/00
248/311.2

* cited by examiner

CAN HOLDER SYSTEM

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

1. FIELD OF THE INVENTION

The present invention relates generally to the field of article carriers and more specifically relates to container holders.

2. DESCRIPTION OF RELATED ART

In the beverage industry there are thousands of containers made from different materials in a variety of colors and shapes to promote the contents of the container. The 355-ml aluminum can with a pop top is the choice of most large volume drink manufacturers. After the beverage has been opened and the first sip has been savored it typically must be placed on a flat surface or held in one's hands until completely consumed. If no such place is available at the time holding a can or container for an extended period of time is uncomfortable. A suitable solution is desired.

U.S. Pat. No. 4,893,773 to Takeo Fujimoto relates to an article holder for use in a car door. The described article holder for use in a car door includes an article holder for use in a car door comprising an insertion portion to be inserted in the space between a door glass and an inside door, a lateral holding portion continuing from the insertion member fold at an outside bend line and having a reinforcing member for reinforcing the lateral holding portion, the lateral holding portion having further a support member which can be adjusted by selectively bending at any of the inside fold lines depending on the thickness of the inside door, a tab for fixedly positioning the support member, a longitudinal holding portion continuing from the lateral holding portion, a truncated disc member which is substantially in shape and extends between the lateral holding portion and the longitudinal holding portion, a lateral inside support member provided in the longitudinal holding portion and continuing from the truncated disc member. The article holder further includes a rubber engagement member at the outside fold lines provided between the insertion portion and the lateral holding portion.

BRIEF SUMMARY OF THE INVENTION

In view of the foregoing disadvantages inherent in the known article carrier art, the present disclosure provides a novel can holder system. The general purpose of the present disclosure, which will be described subsequently in greater detail, is to provide a beverage container caddy for mounting on a belt or to a wall for storage of a beverage can between drinks.

A can holder system is disclosed herein. The can holder system includes a stamped sheet having a first-section including a first-tab, and a second-tab, a second-section including a third-tab, and a fourth-tab, an arcuate-member, and a plurality of folding joints. The stamped sheet is configured to fold at the plurality of folding joints for supporting the container in a substantially upright position (relatively speaking such that the contents of the container are not spilled). The first-section comprises the first-tab and the second-tab at a top-end. The arcuate-member is positioned at a bottom-end of the first-section. The second-section extends from the accurate-member. The first-tab and the second-tab are configured to fold in relation to each other creating a u-shaped member. The second-section extends along a length of the container during an in-use condition. The third-tab is configured to support the container at a base. The fourth-tab extends from the third-tab preferably at about 45 degrees when folded at one of the plurality of folding joints connecting the fourth-tab and the third-tab. The fourth-tab is configured to further support the container and wrap around a front edge of the base. The device may be stored in a planar position and be folded at a plurality of folding joints to secure and support a container.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a can holder system, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to an article carrier and more particularly to a can holder system as used to improve the storage of a can or container during use.

Generally, the invention is a 'can caddy'; a can holder system which ships and stores flat. The device includes precision "bend" lines allow a user to create the finished product on site, when needed by following a short series of bends. No tools are required. The can holder system may be clipped over a belt and support a can or beverage container between uses. The can holder system may be made of 0.063 aluminum and anodized in a selection of colors. Other materials may be used. The device may accommodate a plurality of sizes and shapes of beverage containers such as water bottles, cups and the like. After a beverage has been opened and the first sip has been savored the beverage container may be placed in the can holder system for storage.

Figure 1:
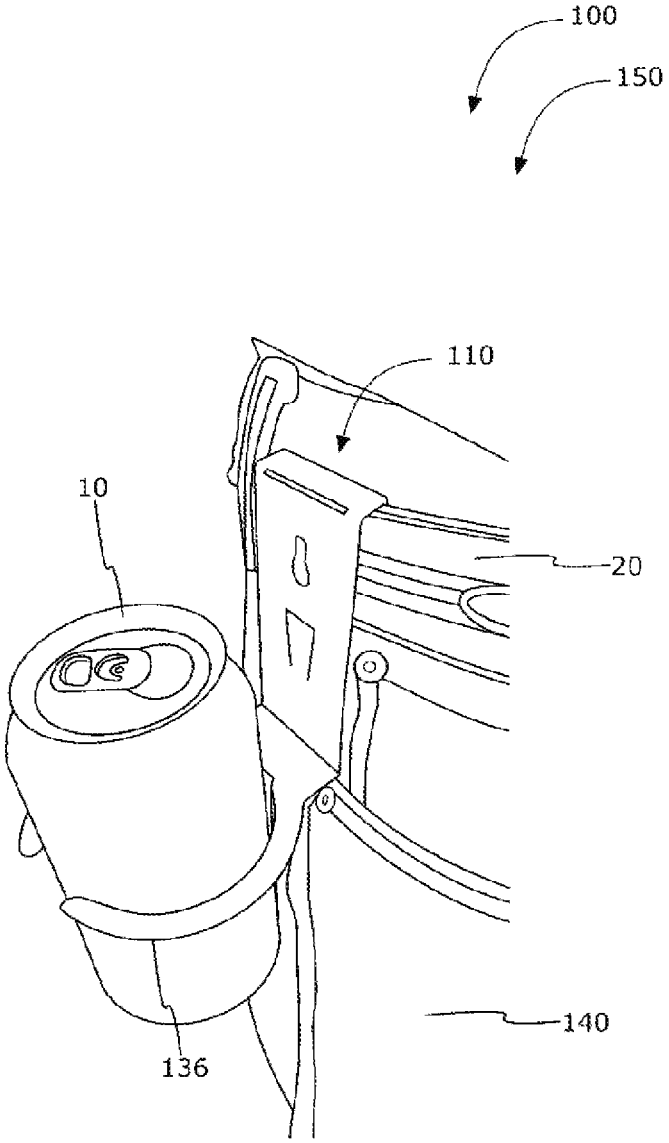
FIG. 1 is a perspective view of the can holder system during an 'in-use' condition, according to an embodiment of the disclosure.

Referring now more specifically to the drawings by numerals of reference, there is shown in FIGS. 1-5B, various views of a can holder system 100. FIG. 1 shows a can holder system 100 during an 'in-use' condition 150, according to an embodiment of the present disclosure. As illustrated, the can holder system 100 may include a stamped sheet 110 including a first-section 120 having a first-tab 122 and a second-tab 124, a second-section 130 including a third-tab 132, and a fourth-tab 134, an arcuate-member 136, and a plurality of folding joints 160. The stamped sheet 110 is configured to fold at the plurality of folding joints 160 for supporting a container 10 in a substantially upright position. The device provides support means for conveniently storing a container 10 between drinks consumed.

Figure 2:
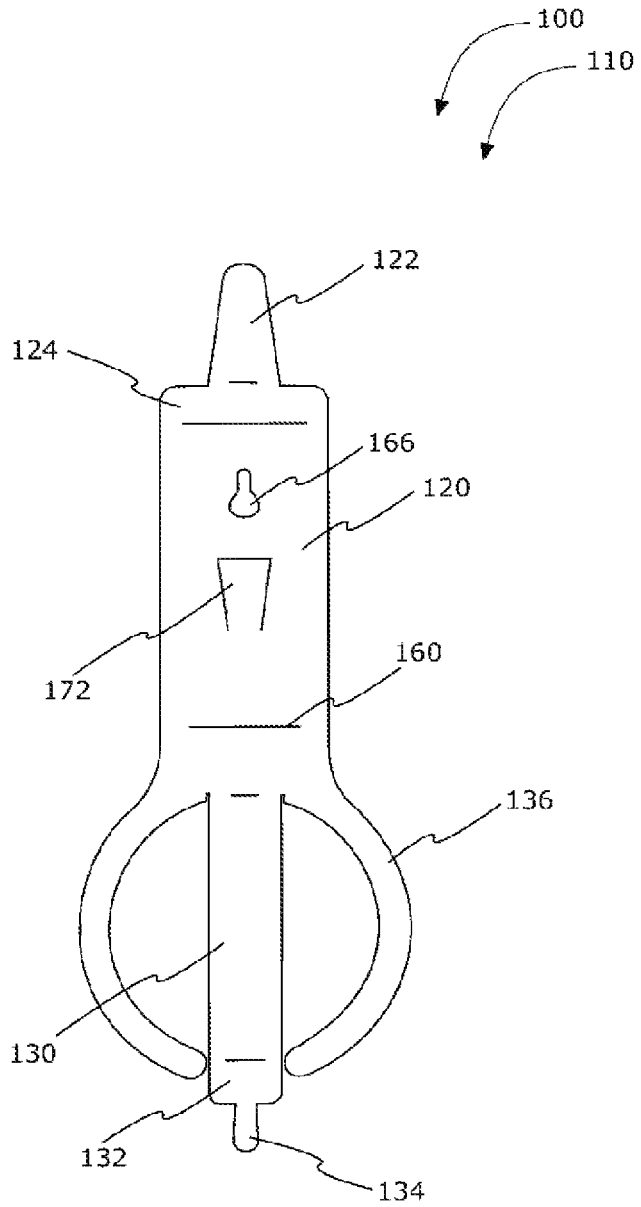
FIG. 2 is a perspective view of the can holder system of FIG. 1, according to an embodiment of the present disclosure.

FIG. 2 shows a perspective view of the can holder system 100 of FIG. 1, according to an embodiment of the present disclosure. As above, the can holder system 100 may include the stamped sheet 110 having the first-section 120 including the first-tab 122 and the second-tab 124, the second-section 130 including the third-tab 132, and the fourth-tab 134, the arcuate-member 136, and the plurality of folding joints 160. The first-section 120 comprises the first-tab 122 and the second-tab 124 at a top-end. The arcuate-member 136 is positioned at a bottom-end of the first-section 120. The second-section 130 extends from the accurate-member 136. The first-tab 122 and the second-tab 124 are configured to fold in relation to each other creating a u-shaped member at the top of the device. The u-shaped member is created by folding a first of the plurality folding joints 160 and a second one of the plurality folding joints 160. The u-shaped member is configured to receive a belt 20 and support the device at a waist of a user 140.

Figure 3:
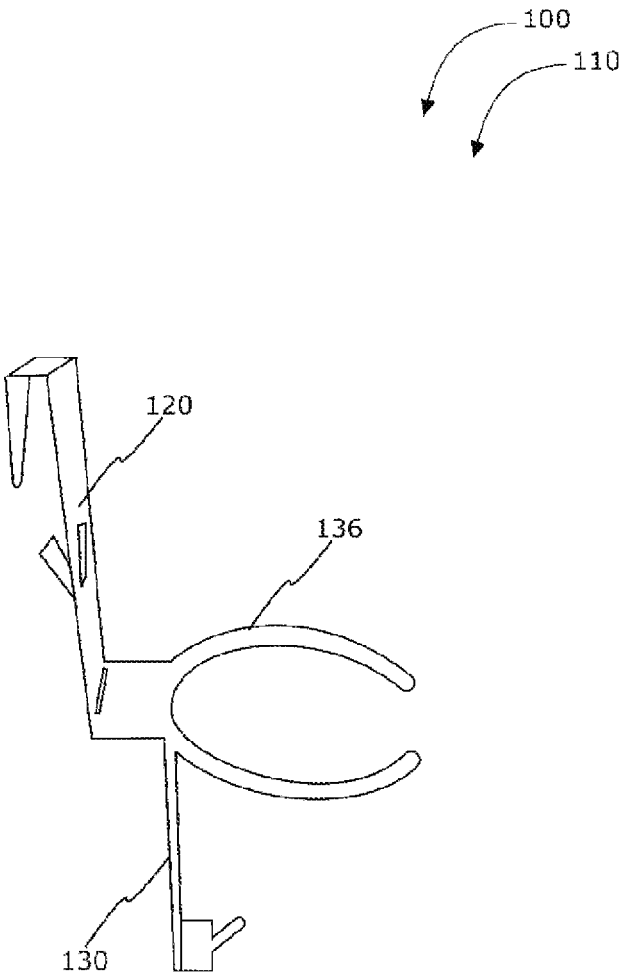
FIG. 3 is a perspective view of the can holder system of FIG. 1, according to an embodiment of the present disclosure.

Referring now to FIG. 3 showing a perspective view of the can holder system 100 of FIG. 1, according to an embodiment of the present disclosure. As above, the can holder system 100 may include the stamped sheet 110 having a plurality of folding joints 160. The plurality of folding joints 160 are configured to snap into place. The plurality of folding joints 160 may be folded to create a container caddy. The plurality of folding joints 160 may be folded and snapped in to position from a planar position. Once folded, the device stays in a folded position until otherwise manipulated. The device is semi-rigid and configured to support a weight (mass) of the container. The can holder system 100 is storable in planar position before use. The planar position before use is configured to fold at the plurality of folding joints creating a can holder configured to be mounted to a belt 20.

Figure 4A:
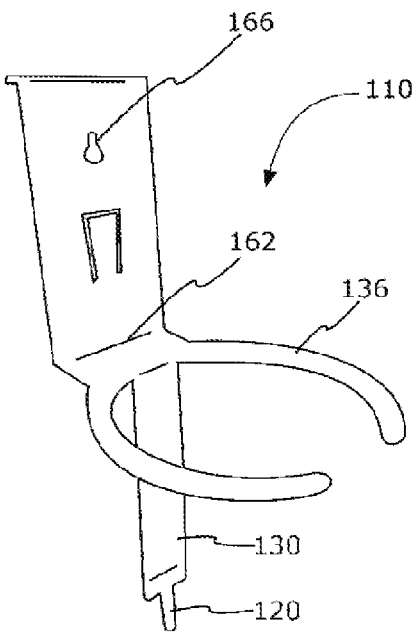
FIG. 4A is a perspective view of the can holder system of FIG. 1, according to an embodiment of the present disclosure.

FIG. 4A shows a perspective view of the can holder system 100 of FIG. 1, according to an embodiment of the present disclosure. As above, the can holder system 100 may include the stamped sheet 110 having the first-section 120 including the first-tab 122, and the second-tab 124, the second-section 130 including the third-tab 132, and the fourth-tab 134, the arcuate-member 136, and the plurality of folding joints 160. The first-section 120, the first-tab 122 and the second-tab 124 when folded create a u-shaped profile configured to receive a belt 20. The first-section 120 further comprises a wall mount aperture 166. The first-tab 122 and the second-tab 124 may be detached from the first-section 120 and allow a user 140 to mount the device to a wall using the wall mount aperture 166.

Figure 4B:
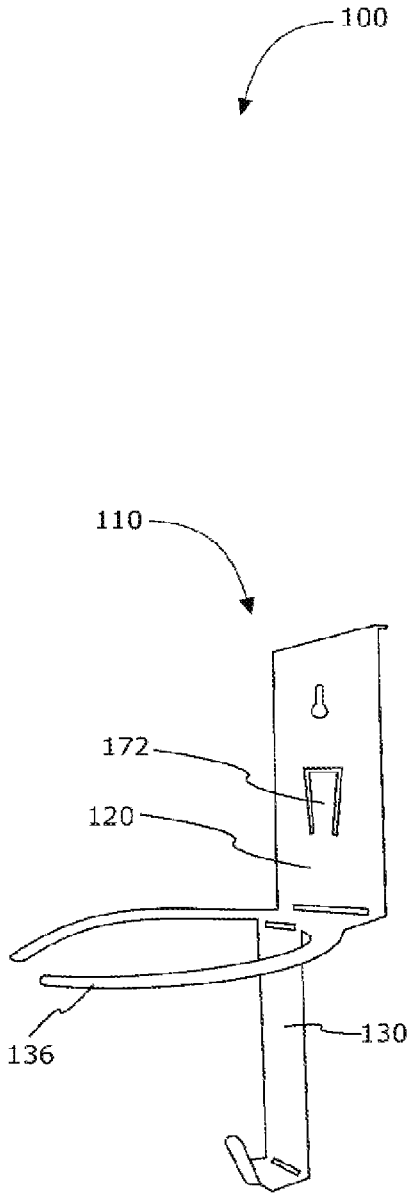
FIG. 4B is a perspective view of the can holder system of FIG. 1, according to an embodiment of the present disclosure.

Referring now to FIG. 4B showing a perspective view of the can holder system 100 of FIG. 1, according to an embodiment of the present disclosure. As above, the can holder system 100 may include the stamped sheet 110 having the first-section 120, the second-section 130, the arcuate-member 136, and the plurality of folding joints 160. The arcuate-member 136 is configured to partially encircle a container 10 during use. The actuate-member 136 is positioned in a middle section between the first-section 120 and the second-section 130. The arcuate-member 136 comprises an open end opposing a user 140 during use. The arcuate-member 136 is connected to the first-section 120 and the second-section 130 via the plurality of folding joints 160. The second-section 130 extends along a length of the container 10 during use.

Figure 5A:
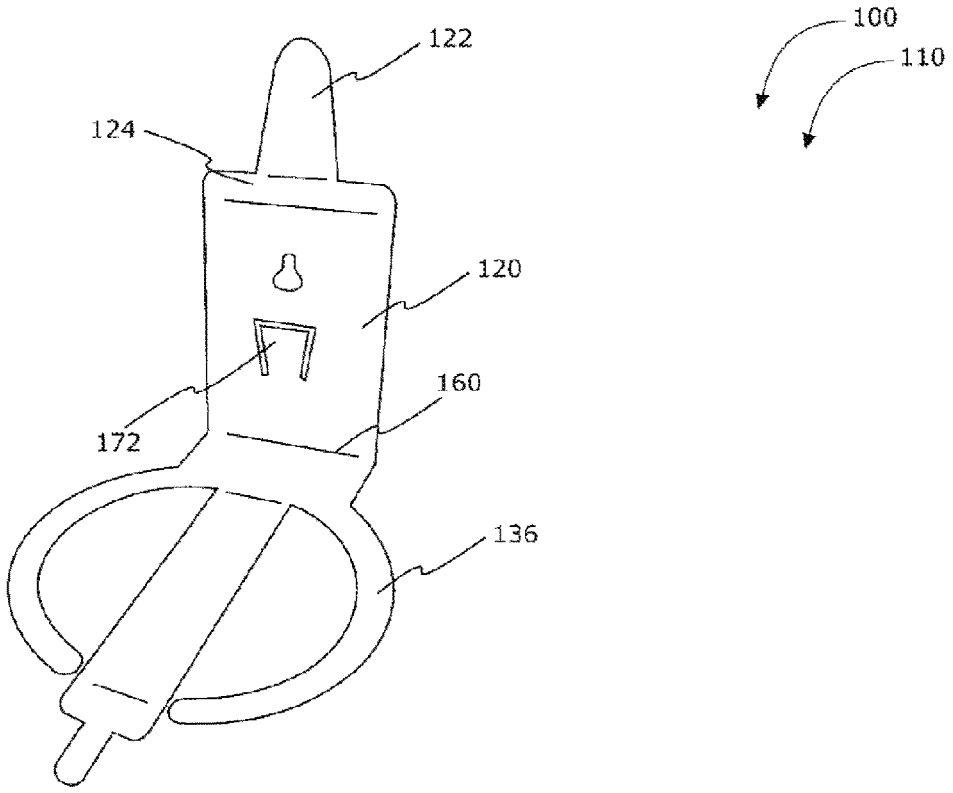
FIG. 5A is a perspective view of the can holder system of FIG. 1, according to an embodiment of the present disclosure.
Figure 5B:
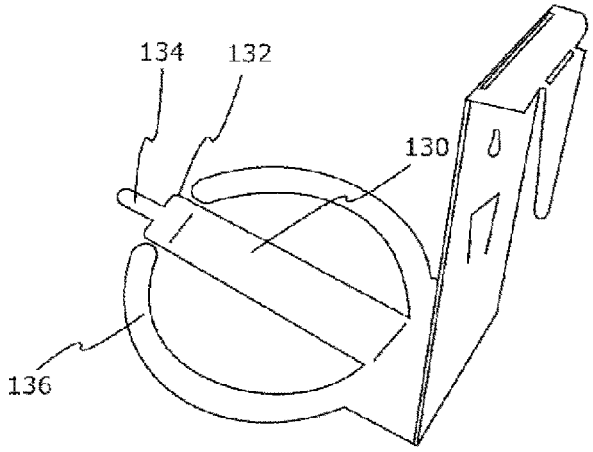
FIG. 5B is a perspective view of the can holder system of FIG. 1, according to an embodiment of the present disclosure.

FIGS. 5A and 5B show perspective views of the can holder system 100 of FIG. 1, according to an embodiment of the present disclosure. As above, the can holder system 100 may include the stamped sheet 110 having the first-section 120 including the first-tab 122 and the second-tab 124, the second-section 130 including the third-tab 132, and the fourth-tab 134, the arcuate-member 136, and the plurality of folding joints 160. The second-section 130 includes the third-tab 132 and the fourth-tab 134 which are configured to support the container 10 at a base. The third-tab 132 and the fourth-tab 134 may be folded at a third of the plurality folding joints 160 and a fourth of the plurality folding joints 160. The fourth-tab 134 extends from the third-tab 132 at 45 degrees (other angles may be used in alternate embodiments) when folded at one of the plurality of folding joints 160 connecting the fourth-tab 134 and the third-tab 132. The fourth-tab 134 is configured to further support the container 10 and wrap around a front edge of the base. The can holder system 100 may be disposable and recyclable. In certain embodiments, the first-section 120 may include a fifth-tab 172 configured to be folded and extend from the first-section 120.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A can holder system comprising:

a stamped sheet including;

a first-section including;

a first-tab;

and a second-tab;

a second-section including;
a third-tab;
and
a fourth-tab;
an arcuate-member;
and
a plurality of folding joints;
wherein said first-section comprises said first-tab and said second-tab at a top-end and said arcuate-member is positioned at a bottom-end of said first-section
wherein said second-section extends from said arcuate member;
wherein said first-tab and said second-tab are configured to fold in relation to each other creating a u-shaped member;
wherein said arcuate-member is configured to partially encircle a container during use;
wherein said fourth-tab extends from said third-tab at 45 degrees when folded at one of said plurality of folding joints connecting said fourth-tab and said third-tab;
and
wherein said stamped sheet is configured to fold at said plurality of folding joints for supporting said container in a substantially upright position.

2. The can holder system of claim 1, wherein said arcuate member is positioned in a middle section between said first-section and said second-section.

3. The can holder system of claim 1, wherein said third-tab is configured to support said container at a base.

4. The can holder system of claim 3, wherein said fourth-tab is configured to further support said container and wrap around a front edge of said base.

5. The can holder system of claim 1, wherein said arcuate-member comprises an open end opposing a user during use.

6. The can holder system of claim 5, wherein said arcuate member is connected to said first-section and said second-section via said plurality of folding joints.

7. The can holder system of claim 6, wherein said second-section extends along a length of said container.

8. The can holder system of claim 1, wherein said first-section, said first-tab and said second-tab when folded create a u-shaped profile configured to receive a belt.

9. The can holder system of claim 1, wherein said can holder is semi-rigid and configured to support a weight of said container.

10. The can holder system of claim 1, wherein said can holder system is storable in a planar position before use.

11. The can holder system of claim 10, wherein said planar position before use is configured to fold at said plurality of folding joints creating a can holder configured to be mounted to a belt.

12. The can holder system of claim 1, wherein said first-tab and said second-tab are detachable.

13. The can holder system of claim 1, wherein said first-section further comprises a wall mount aperture.

14. The can holder system of claim 1, wherein said can holder system is disposable.

15. The can holder system of claim 1, wherein said first-section further comprises a fifth-tab configured to be folded at one of said plurality of folding joints and extends from said first-section.

16. The can holder system of claim 1, wherein said plurality of folding joints are configured to snap into place.

17. A can holder system comprising:
a stamped sheet including;
a first-section including;
a first-tab;
and
a second-tab;
a second-section including;
a third-tab;
and
a fourth-tab;
an arcuate-member;
and
a plurality of folding joints;
wherein said first-section comprises said first-tab and said second-tab at a top-end and said arcuate-member is positioned at a bottom-end of said first-section
wherein said second-section extends from said arcuate member;
wherein said first-tab and said second-tab are configured to fold in relation to each other creating a u-shaped member;
wherein said first-tab and said second-tab are detachable;
wherein said arcuate-member is positioned in a middle section between said first-section and said second-section;
wherein said arcuate-member is configured to partially encircle a container during use;
wherein said arcuate-member comprises an open end opposing a user during use;
wherein said arcuate-member is connected to said first-section and said second-section via said plurality of folding joints;
wherein said second-section extends along a length of said container;
wherein said fourth-tab extends from said third-tab at 45 degrees when folded at one of said plurality of folding joints connecting said fourth-tab and said third-tab;
wherein said third-tab is configured to support said container at a base;
wherein said fourth-tab is configured to further support said container and wrap around a front edge of said base;
wherein said first-section, said first-tab and said second-tab when folded create a u-shaped profile configured to receive a belt;
wherein said first-section further comprises a wall mount aperture;
wherein said first-section further comprises a fifth-tab configured to be folded at one of said plurality of folding joints and extends from said first-section;
wherein said can holder is semi-rigid and configured to support a weight of said container;
wherein said stamped sheet is configured to fold at said plurality of folding joints for supporting said container in a substantially upright position;
wherein said can holder system is storable in a planar position before use;
wherein said planar position before use is configured to fold at said plurality of folding joints creating a can holder configured to be mounted to a belt;
and
wherein said plurality of folding joints are configured to snap into place.

* * * * *